US008789317B2

(12) United States Patent
Cheh

(10) Patent No.: US 8,789,317 B2
(45) Date of Patent: Jul. 29, 2014

(54) METHOD FOR FORMING A DOUBLE-CURVED STRUCTURE AND DOUBLE-CURVED STRUCTURE FORMED USING THE SAME

(71) Applicant: James L. Cheh, Tulsa, OK (US)

(72) Inventor: James L. Cheh, Tulsa, OK (US)

( * ) Notice: Subject to any disclaimer, the term of this patent is extended or adjusted under 35 U.S.C. 154(b) by 0 days.

(21) Appl. No.: 13/743,430

(22) Filed: Jan. 17, 2013

(65) Prior Publication Data

US 2013/0180184 A1 Jul. 18, 2013

Related U.S. Application Data

(60) Provisional application No. 61/587,229, filed on Jan. 17, 2012.

(51) Int. Cl.

| | |
|---|---|
| ***E04B 1/32*** | (2006.01) |
| ***D04H 13/00*** | (2006.01) |
| ***D04H 3/04*** | (2012.01) |

(52) U.S. Cl.

CPC *E04B 1/32* (2013.01); *D04H 13/00* (2013.01); *D04H 3/04* (2013.01); *Y10S 52/10* (2013.01)

USPC ..... 52/80.1; 29/428; 29/525.01; 29/525.05; 52/80.2; 52/745.2; 52/DIG. 10; 428/175

(58) Field of Classification Search

CPC ..... D04H 13/00; D04H 3/04; E04B 1/32; E04B 1/3205; E04B 1/3211

USPC ..... 52/80.1, 80.2, 81.1, 81.2, 81.3, 81.4, 52/81.5, 81.6, DIG. 10, 635, 636, 645, 52/646, 745.19, 745.2; 428/175; 29/428, 29/525.01, 525.05

See application file for complete search history.

(56) References Cited

U.S. PATENT DOCUMENTS

| | | | | | |
|---|---|---|---|---|---|
| 2,592,465 | A | * | 4/1952 | Pont | 52/81.2 |
| 2,948,047 | A | * | 8/1960 | Peeler et al. | 264/32 |
| 2,989,145 | A | * | 6/1961 | Goodloe | 55/443 |
| 3,060,949 | A | * | 10/1962 | Moss | 135/87 |
| 3,201,894 | A | * | 8/1965 | Resch | 446/487 |
| 3,215,153 | A | * | 11/1965 | Huddle | 135/129 |
| 3,240,656 | A | * | 3/1966 | Faircloth | 428/175 |
| 3,297,461 | A | * | 1/1967 | Siddall | 428/136 |

(Continued)

FOREIGN PATENT DOCUMENTS

| | | |
|---|---|---|
| JP | 58-025829 | 2/1983 |
| JP | 10-334265 | 12/1998 |

(Continued)

OTHER PUBLICATIONS

Machine Translation of SU 1270256 A retrieved from Espacenet.com on Jan. 13, 2014 (1 page).*

(Continued)

*Primary Examiner* — Basil Katcheves
*Assistant Examiner* — Rodney Mintz
(74) *Attorney, Agent, or Firm* — Ked & Associates LLP

(57) ABSTRACT

A method for forming a double-curved structure and double-curved structure formed using the same are provided. The method may include providing a flat mesh formed of a plurality of strands; interlinking the plurality of strands of the flat mesh using a plurality of cross-links; and adjusting the plurality of cross-links to form the double-curved structure.

27 Claims, 10 Drawing Sheets

(56) References Cited

U.S. PATENT DOCUMENTS

| | | | | | |
|---|---|---|---|---|---|
| 3,308,597 | A * | 3/1967 | Simonton | 52/635 |
| 3,410,039 | A * | 11/1968 | Brezina | 52/81.2 |
| 3,626,647 | A * | 12/1971 | Guzelimian | 52/80.2 |
| 3,653,166 | A * | 4/1972 | Kirschen | 52/80.2 |
| 3,699,987 | A * | 10/1972 | Huddle | 52/63 |
| 3,772,836 | A * | 11/1973 | Geiger | 52/81.2 |
| 3,835,599 | A * | 9/1974 | Geiger | 52/2.25 |
| 3,841,038 | A * | 10/1974 | Geiger | 52/81.2 |
| 3,909,993 | A * | 10/1975 | Huddle | 52/63 |
| 3,970,301 | A * | 7/1976 | Lehmann | 482/35 |
| 4,059,932 | A * | 11/1977 | Resch | 52/81.1 |
| 4,124,925 | A * | 11/1978 | Barnett | 29/6.2 |
| 4,128,104 | A | 12/1978 | Corey | |
| 4,154,253 | A * | 5/1979 | McCullough | 135/124 |
| 4,259,385 | A * | 3/1981 | Keller | 428/135 |
| 4,271,628 | A * | 6/1981 | Barlow | 446/126 |
| 4,271,641 | A * | 6/1981 | Kawaguchi | 52/2.18 |
| 4,277,922 | A | 7/1981 | McAllister | |
| 4,297,154 | A * | 10/1981 | Keller | 156/79 |
| 4,452,017 | A * | 6/1984 | Tang et al. | 52/2.17 |
| 4,456,258 | A * | 6/1984 | Lodrick | 273/241 |
| 4,471,585 | A * | 9/1984 | Peter | 52/18 |
| 4,581,860 | A * | 4/1986 | Berger | 52/63 |
| 4,711,062 | A * | 12/1987 | Gwilliam et al. | 52/646 |
| 4,731,962 | A * | 3/1988 | Kittner et al. | 52/81.2 |
| 4,901,483 | A * | 2/1990 | Huegy | 52/81.2 |
| 5,029,779 | A * | 7/1991 | Bruggeman | 245/4 |
| 5,036,635 | A * | 8/1991 | Lalvani | 52/80.1 |
| 5,069,009 | A * | 12/1991 | Suzuki | 52/81.3 |
| 5,265,395 | A * | 11/1993 | Lalvani | 52/648.1 |
| 5,330,400 | A | 7/1994 | Huberman | |
| 5,448,868 | A * | 9/1995 | Lalvani | 52/648.1 |
| 5,505,035 | A * | 4/1996 | Lalvani | 52/648.1 |
| 5,524,396 | A * | 6/1996 | Lalvani | 52/81.1 |
| 5,615,528 | A * | 4/1997 | Owens | 52/576 |
| 5,623,790 | A * | 4/1997 | Lalvani | 52/81.2 |
| 5,657,605 | A * | 8/1997 | Sidney | 52/664 |
| 5,660,003 | A * | 8/1997 | Owens | 52/81.1 |
| 5,888,608 | A * | 3/1999 | Tsai | 428/105 |
| 5,993,941 | A * | 11/1999 | Vasiliev et al. | 428/178 |
| 6,027,785 | A * | 2/2000 | Yoshida | 428/131 |
| 6,192,634 | B1 * | 2/2001 | Lopez | 52/81.2 |
| 6,334,284 | B1 * | 1/2002 | Provitola | 52/698 |
| 6,345,482 | B1 * | 2/2002 | Warren | 52/646 |
| 6,347,435 | B1 * | 2/2002 | Davignon et al. | 24/16 PB |
| 6,412,232 | B1 * | 7/2002 | Provitola | 52/80.1 |
| 6,418,673 | B1 * | 7/2002 | Flowerday | 52/81.1 |
| 6,457,282 | B1 | 10/2002 | O'Toole | |
| 6,470,643 | B1 * | 10/2002 | Cantley | 52/660 |
| D470,600 | S * | 2/2003 | Cantley | D25/100 |
| 7,052,437 | B2 * | 5/2006 | Kohler | 482/51 |
| 7,069,699 | B2 * | 7/2006 | Provitola | 52/81.3 |
| 7,108,233 | B2 * | 9/2006 | Giuseppin | 245/5 |
| 7,143,550 | B1 * | 12/2006 | Lopez | 52/81.3 |
| 7,290,756 | B2 * | 11/2007 | Pavlov | 256/2 |
| 7,389,612 | B1 | 6/2008 | Fischbeck | |
| 7,461,501 | B1 * | 12/2008 | Bajema | 59/93 |
| 7,493,924 | B2 * | 2/2009 | Garcia et al. | 140/92.7 |
| 7,591,108 | B2 * | 9/2009 | Tuczek | 52/80.1 |
| 7,694,463 | B2 * | 4/2010 | Lanahan | 52/81.1 |
| 7,694,465 | B2 * | 4/2010 | Pryor | 52/108 |
| 7,726,078 | B2 * | 6/2010 | Kolozsvary-Kiss | 52/86 |
| 7,839,353 | B2 | 11/2010 | Bassily | |
| 7,883,425 | B2 * | 2/2011 | Joseph | 472/88 |
| 7,900,405 | B1 * | 3/2011 | Jacoby | 52/81.3 |
| 7,909,067 | B2 * | 3/2011 | Offersen et al. | 140/5 |
| 7,921,537 | B2 * | 4/2011 | Rodlin | 29/464 |
| 7,992,353 | B2 * | 8/2011 | Athan | 52/81.3 |
| 8,042,312 | B2 * | 10/2011 | Kang et al. | 52/664 |
| 8,079,782 | B1 * | 12/2011 | Hilfiker et al. | 405/262 |
| 8,082,938 | B2 * | 12/2011 | Prusmack | 135/135 |
| 8,084,117 | B2 * | 12/2011 | Lalvani | 428/136 |
| 8,096,085 | B2 * | 1/2012 | Schneider et al. | 52/81.3 |
| 8,201,364 | B1 * | 6/2012 | Tomas | 52/90.2 |
| 8,226,882 | B2 * | 7/2012 | Takaoka | 264/622 |
| 8,277,210 | B2 * | 10/2012 | Takaoka | 425/71 |
| 8,286,392 | B2 * | 10/2012 | Noble et al. | 52/79.4 |
| 8,352,224 | B2 * | 1/2013 | Whitehead | 703/2 |
| 8,356,448 | B2 * | 1/2013 | Nihei | 52/223.8 |
| 8,418,730 | B2 * | 4/2013 | Kang et al. | 140/5 |
| 8,474,764 | B2 * | 7/2013 | Kieselstein et al. | 245/5 |
| 8,563,121 | B2 * | 10/2013 | Takaoka | 428/218 |
| 8,563,123 | B2 * | 10/2013 | Takaoka | 428/220 |
| 8,568,635 | B2 * | 10/2013 | Takaoka | 264/171.2 |
| 8,616,328 | B2 * | 12/2013 | Daraio et al. | 181/175 |
| 8,621,822 | B2 * | 1/2014 | Brockwell | 52/831 |
| 8,672,092 | B2 * | 3/2014 | Black | 182/150 |
| 8,689,514 | B1 * | 4/2014 | Sternowski | 52/646 |
| 2002/0112413 | A1 * | 8/2002 | Hoberman | 52/71 |
| 2002/0124518 | A1 * | 9/2002 | Warren et al. | 52/646 |
| 2003/0171155 | A1 * | 9/2003 | Miller | 472/90 |
| 2004/0134136 | A1 * | 7/2004 | Shearing | 52/81.2 |
| 2004/0134141 | A1 | 7/2004 | Hebbelinck | |
| 2004/0148901 | A1 * | 8/2004 | Cadogan et al. | 52/646 |
| 2004/0159053 | A1 * | 8/2004 | Provitola | 52/80.1 |
| 2004/0172888 | A1 * | 9/2004 | Shearing | 52/81.1 |
| 2005/0235921 | A1 * | 10/2005 | Niezrecki et al. | 119/223 |
| 2006/0272265 | A1 * | 12/2006 | Pryor | 52/645 |
| 2007/0094972 | A1 * | 5/2007 | Hess | 52/410 |
| 2007/0095012 | A1 * | 5/2007 | Kang et al. | 52/750 |
| 2007/0125033 | A1 * | 6/2007 | Stephan et al. | 52/655.1 |
| 2007/0251161 | A1 * | 11/2007 | Tuczek | 52/80.1 |
| 2008/0040984 | A1 * | 2/2008 | Lanahan | 52/79.9 |
| 2008/0193709 | A1 * | 8/2008 | Han | 428/100 |
| 2008/0276564 | A1 * | 11/2008 | Offersen et al. | 52/676 |
| 2008/0277638 | A1 * | 11/2008 | Benner et al. | 256/11 |
| 2009/0038206 | A1 * | 2/2009 | Conte | 43/7 |
| 2009/0044459 | A1 | 2/2009 | Kolozsvary-Kiss | |
| 2009/0129031 | A1 | 5/2009 | Someya et al. | |
| 2009/0171426 | A1 * | 7/2009 | Magnuson | 623/1.2 |
| 2009/0214821 | A1 * | 8/2009 | Walsh | 428/131 |
| 2009/0269571 | A1 * | 10/2009 | Takaoka | 428/222 |
| 2010/0037930 | A1 * | 2/2010 | Miller | 135/143 |
| 2010/0071300 | A1 * | 3/2010 | Kang et al. | 52/646 |
| 2010/0139202 | A1 * | 6/2010 | Athan | 52/655.1 |
| 2010/0162637 | A1 * | 7/2010 | Brell-Cokcan | 52/80.1 |
| 2010/0233421 | A1 * | 9/2010 | Lind et al. | 428/108 |
| 2010/0314502 | A1 * | 12/2010 | Miles et al. | 248/59 |
| 2011/0061315 | A1 * | 3/2011 | Kisanakis | 52/167.1 |
| 2011/0112476 | A1 * | 5/2011 | Kauphusman et al. | 604/95.04 |
| 2011/0146166 | A1 * | 6/2011 | Noble | 52/167.1 |
| 2011/0167738 | A1 * | 7/2011 | Schneider et al. | 52/81.3 |
| 2011/0168220 | A1 * | 7/2011 | Prusmack | 135/135 |
| 2011/0179723 | A1 * | 7/2011 | Jacques | 52/80.1 |
| 2011/0179724 | A1 * | 7/2011 | Hooper | 52/80.1 |
| 2011/0192014 | A1 * | 8/2011 | Holmes et al. | 29/525.01 |
| 2011/0316185 | A1 * | 12/2011 | Takaoka | 264/112 |
| 2012/0094060 | A1 * | 4/2012 | Gershenfeld et al. | 428/99 |
| 2012/0104646 | A1 * | 5/2012 | Takaoka | 264/165 |
| 2012/0180939 | A1 * | 7/2012 | Takaoka | 156/181 |
| 2012/0297698 | A1 * | 11/2012 | Edwards | 52/81.6 |
| 2012/0301701 | A1 * | 11/2012 | Takaoka | 428/222 |
| 2012/0311941 | A1 * | 12/2012 | Edwards et al. | 52/79.9 |
| 2012/0319323 | A1 * | 12/2012 | Takaoka | 264/210.1 |
| 2012/0328722 | A1 * | 12/2012 | Takaoka | 425/71 |
| 2013/0047488 | A1 * | 2/2013 | Hey et al. | 43/4.5 |
| 2013/0141915 | A1 * | 6/2013 | Costello et al. | 362/249.06 |
| 2013/0209727 | A1 * | 8/2013 | Orr | 428/99 |
| 2013/0216773 | A1 * | 8/2013 | Walsh | 428/134 |
| 2013/0340373 | A1 * | 12/2013 | Santiago Prowald et al. | 52/646 |
| 2014/0037873 | A1 * | 2/2014 | Cheung et al. | 428/34.1 |
| 2014/0037908 | A1 * | 2/2014 | Takaoka | 428/171 |

FOREIGN PATENT DOCUMENTS

| | | | |
|---|---|---|---|
| SU | 1270256 A | * | 11/1986 |
| WO | WO 2006/052146 | | 5/2006 |
| WO | WO 2008137379 A2 | * | 11/2008 |

OTHER PUBLICATIONS

International Search Report dated Apr. 29, 2013, corresponding to PCT/US2013/021827.

* cited by examiner

METHOD FOR FORMING A DOUBLE-CURVED STRUCTURE AND DOUBLE-CURVED STRUCTURE FORMED USING THE SAME

CROSS-REFERENCE TO RELATED APPLICATION(S)

This application claims priority to U.S. Provisional Application No. 61/587,229 filed on Jan. 17, 2012, whose entire disclosure is hereby incorporated by reference.

BACKGROUND

1. Field

A method for forming a double-curved structure and a double-curved structure formed using the same are disclosed herein.

2. Background

Surfaces may be flat, with no curvature in any direction. The overwhelming majority of man-made surfaces are flat, such as sheets of paper, cloth, plywood, and metal.

Further, a surface may have single curvature, that is, curvature along one axis, but not along the other axis. A cylinder, for example, has curvature around its circumference, but has no curvature parallel to its central longitudinal axis. A cone is another example of a single-curved surface. Single-curved surfaces may be formed by simply rolling a flat starting material into a desired shape.

Furthermore, a surface may be double-curved, with curvature along two axes. The curvatures may both be in a same direction, like a bowl (with both curvatures concave upward) or a dome (with both curvatures concave downward). Alternatively, the curvatures of a double-curved surface may be in opposite directions, concave upward along one axis, concave downward along the other, like a saddle-shaped surface, for example, a Pringles potato chip.

Unlike flat or single-curved surfaces, double-curved surfaces are a challenge to create from typical man-made flat starting materials. Many have experienced this first hand, as it is easy to gift wrap a package that is defined by flat or single-curved surfaces; however, smoothly wrapping a double-curved shape, a basketball, for instance, is a different story.

Creating a double-curved surface from a flat starting material requires the ability to selectively distort the starting material. For a saddle-shaped, double-curved surface, one needs to selectively either tighten up the middle of the material and/or stretch out the edges. For a dome or dish-shaped, double-curved surface, the opposite is required; it is necessary to tighten up the edges of the starting material and/or stretch out the middle.

Traditional methods of creating a double-curved shape from flat starting materials involves precise cutting and joining of flat pieces to attain a desired double-curved shape. The ancient art of tailoring uses this method to achieve the goal of using flat cloth to smoothly cover a double-curved human form.

Another commonly used method of creating a double-curved shape from flat starting materials involves use of highly stretchable materials to accommodate areas that need to be stretched out to create a double-curved surface. For example, a tube sock is a single-curved cylinder of stretchable fabric that relies on the stretchiness of its material to allow it to conform to the double-curved human foot.

These methods may be used in the construction of double-curved structures. Tent-like double curved tensile fabric structures, for example, make use of both of these methods in combination. Flat fabric panels may be cut and joined together with high precision, much like pieces that make up a perfectly tailored piece of clothing. The fabrics used may also be highly stretchable compared to traditional structural materials, such as steel, concrete, and wood. The downside to this kind of construction, however, is cost. Just as a tailored suit is too expensive for most people, a building built in an analogous way is beyond the budget of most prospective building owners. Further, unusual fabric materials and the large deformations they undergo as they stretch make analysis and design of these structures a difficult and very specialized endeavor, further escalating cost.

BRIEF DESCRIPTION OF THE DRAWINGS

Embodiments will be described in detail with reference to the following drawings in which like reference numerals refer to like elements, and wherein.

DETAILED DESCRIPTION

Figure 1:
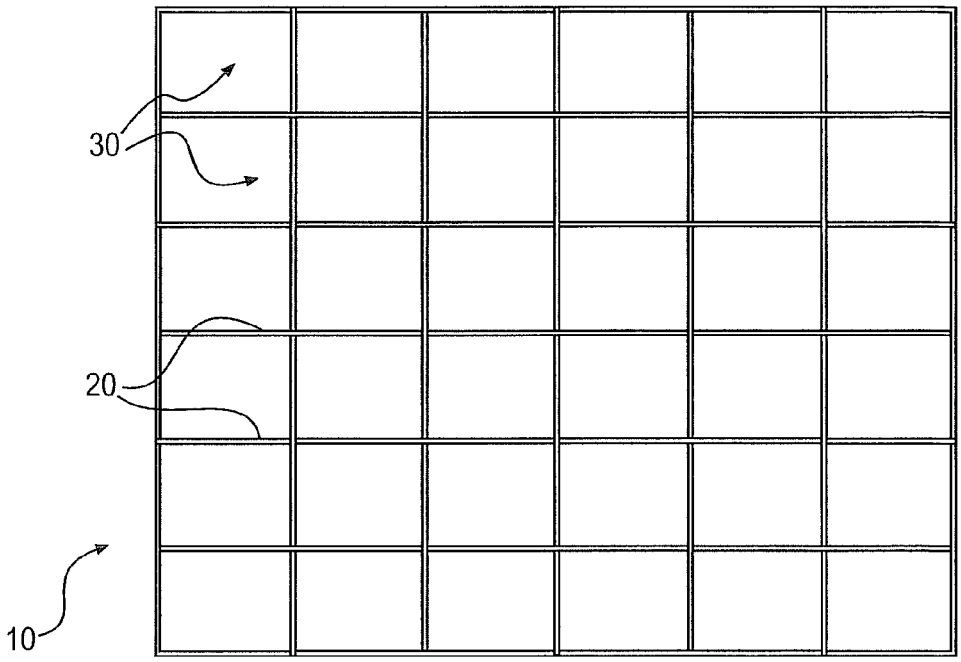
FIG. 1 is a schematic drawing of a flat mesh according to an embodiment.

Embodiments disclosed herein are directed to a method for forming a double-curved structure and a double-curved structure formed using the same. The method according to embodiments disclosed herein may be used, for example, in the construction of buildings and other structures.

Various embodiments are disclosed herein. However, it should be understood that the various elements or steps of the various embodiments may be combined or interchanged to create a desired double-curved structure.

Embodiments disclosed herein provide a novel way by which to create double-curved surfaces. Embodiments disclosed herein produce double-curved surfaces by introducing necessary "tightening up" into a flat net or mesh through the use of a plurality of cross-links to pull strands of the net/mesh into open spaces of the net/mesh. By rerouting the strands along a less direct path, intersections of the net/mesh may be pulled closer together, thus providing the necessary tightening up. The resulting double-curved structure may incorporate different curvatures including different degrees of double, single, and zero curvature at various points across the surface. For example, the structure of FIG. 5 features opposite curvatures at some of the corners. As a consequence of continuity, the structure incorporates an infinite array of intermediate curvatures between those points.

The flat mesh or net according to embodiments disclosed herein may be made of a variety of materials based on a desired application. For example, the flat mesh or net may be made of any material capable of supporting the loads. For a tensile structure, rope made of metal wire, synthetic polymer, natural fibers, or other materials may be used. Appropriate metals may include steel (including carbon, galvanized, and stainless), aluminum, titanium, and alloys. Metal chain may also be substituted for metal wire rope. Appropriate synthetic polymers may include nylon, polyethylene, polyester, PTFE, and ETFE. Appropriate natural fibers may include cotton, coir, sisal, hemp, bamboo, and jute. Appropriate other materials may include fiberglass, carbon fiber, and carbon nanotubes. For a grid shell, structural members that are capable of resisting compression and bending are necessary. Appropriate materials may include steel, wood, and reinforced concrete. The desired or necessary flexibility and/or strength for the particular application may influence the material selected.

The plurality of cross-links according to embodiments disclosed herein may be made of a variety of materials based on a desired application. For example, the plurality of cross-links may be made of any material capable of supporting the loads. For a tensile structure, rope made of metal wire, synthetic polymer, natural fibers, or other materials may be used. Appropriate metals may include steel (including carbon, galvanized, and stainless), aluminum, titanium, and alloys. Metal chain may also be substituted for metal wire rope. Appropriate synthetic polymers may include nylon, polyethylene, polyester, PTFE, and ETFE. Appropriate natural fibers may include cotton, coir, sisal, hemp, bamboo, and jute. Appropriate other materials may include fiberglass, carbon fiber, and carbon nanotubes. For a grid shell, structural members that are capable of resisting compression and bending are necessary. Appropriate materials may include steel, wood, and reinforced concrete. The desired or necessary flexibility and/or strength for the particular application may influence the material selected.

Further, the plurality of cross-links may be adjustable by a user. For example, the plurality of cross-links may be configured to be tightened or loosened by the user, to reroute the individual strands of the flat mesh or net to perform form-finding to obtain a desired double-curved structure.

Alternatively, the plurality of cross-links may be "pre-programmed" to automatically individually expand or compress to reroute the individual strands of the flat mesh or net to obtain a desired double-curved structure. That is, the plurality of cross-links may be made of an elastic material and each of the plurality of cross-links may be configured to expand or compress, such that when the plurality of cross-links are attached to the flat mesh or net, and the flat mesh or net is released or supported, the plurality of cross-links "automatically" expand or compress, respectively, to reroute the individual strands of the flat mesh or net to obtain a desired double-curved structure. A structure may be provided to "lock" the individual cross-links into position.

FIG. 1 is a schematic diagram of a flat mesh according to an embodiment. The flat mesh 10 of FIG. 1 may include a plurality of individual strands 20 arranged, interlaced, or attached, to form a plurality of open spaces 30 between the individual strands 20, to thereby form the flat mesh 10. The plurality of individual strands 20 of the mesh 10 may be interlinked by a plurality of cross-links 40 discussed hereinbelow.

The flat mesh may be made of any material capable of supporting the loads. For a tensile structure, rope made of metal wire, synthetic polymer, natural fibers, or other materials may be used. Appropriate metals may include steel (including carbon, galvanized, and stainless), aluminum, titanium, and alloys. Metal chain may also be substituted for metal wire rope. Appropriate synthetic polymers may include nylon, polyethylene, polyester, PTFE, and ETFE. Appropriate natural fibers may include cotton, coir, sisal, hemp, bamboo, and jute. Appropriate other materials may include fiberglass, carbon fiber, and carbon nanotubes. For a grid shell, structural members that are capable of resisting compression and bending are necessary. Appropriate materials may include steel, wood, and reinforced concrete. The desired or necessary flexibility and/or strength for the particular application may influence the material selected.

In FIG. 1, the flat mesh 10 is shown as square. However, embodiments are not so limited. Other shapes, such as rectangular, round, or oval, are also permissible, based on the application and desired double-curved structure.

Figure 2A:
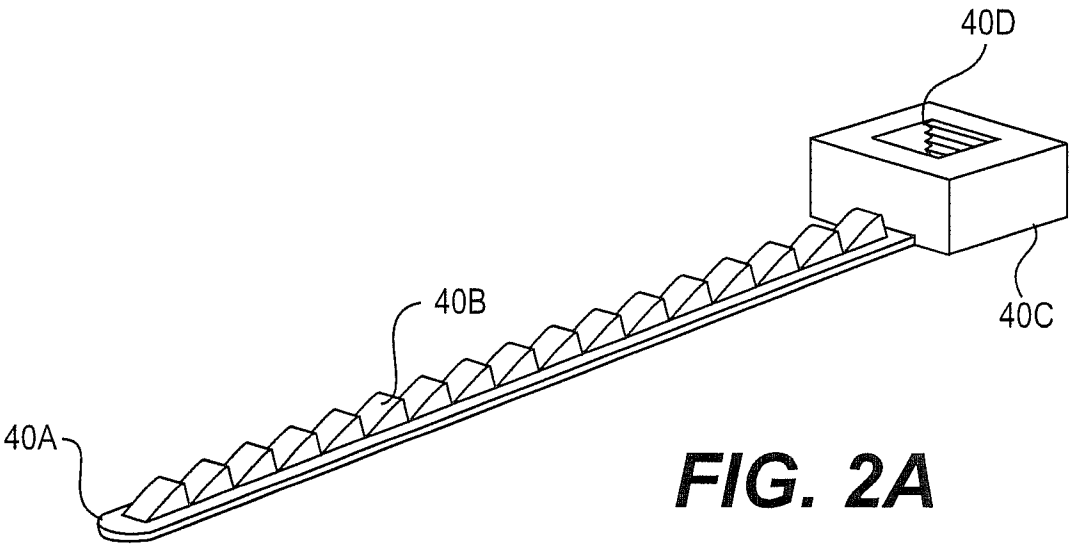
FIGS. 2A-2B are schematic drawing of an exemplary cross-link according to an embodiment.
Figure 2B:
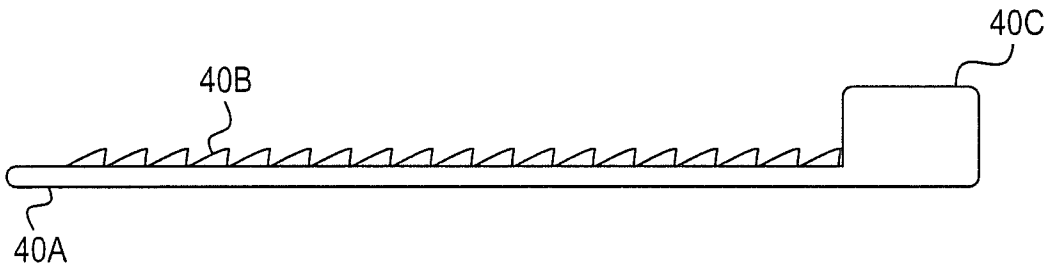

FIGS. 2A-2B are schematic diagrams of an exemplary cross-link according to an embodiment. The cross-link 40 of FIGS. 2A-2B may be used to interlink two or more individual strands 20 of the flat mesh 10 to narrow or widen the open spaces 30 between the individual strands 20. The cross-link 40 is shown in FIGS. 2A-2B as a zip-style cable tie having a tape section 40A having a plurality of teeth 40B that slope in one direction. A head 40C of the cable tie may have a slot 40D with a flexible pawl (not shown) disposed therein. The flexible pawl may be configured to ride up the slope of the teeth 40B when the tape section 40A is inserted into the slot 40D. The pawl may engage a back side of the teeth 40B to stop removal of the tape section 40A from the head 40C.

Although the cross-link is shown in FIGS. 2A-2B as a zip style cable tie, embodiments are not so limited. Other types of cross-links may also be appropriate.

The cross-links 40 of FIGS. 2A-2B may be made of any material capable of supporting the loads. For a tensile structure, rope made of metal wire, synthetic polymer, natural fibers, or other materials may be used. Appropriate metals may include steel (including carbon, galvanized, and stainless), aluminum, titanium, and alloys. Metal chain may also be substituted for metal wire rope. Appropriate synthetic polymers may include nylon, polyethylene, polyester, PTFE, and ETFE. Appropriate natural fibers may include cotton, coir, sisal, hemp, bamboo, and jute. Appropriate other materials may include fiberglass, carbon fiber, and carbon nanotubes. For a grid shell, structural members that are capable of resisting compression and bending are necessary. Appropriate materials may include steel, wood, and reinforced concrete. The desired or necessary flexibility and/or strength for the particular application may influence the material selected.

Figure 3:
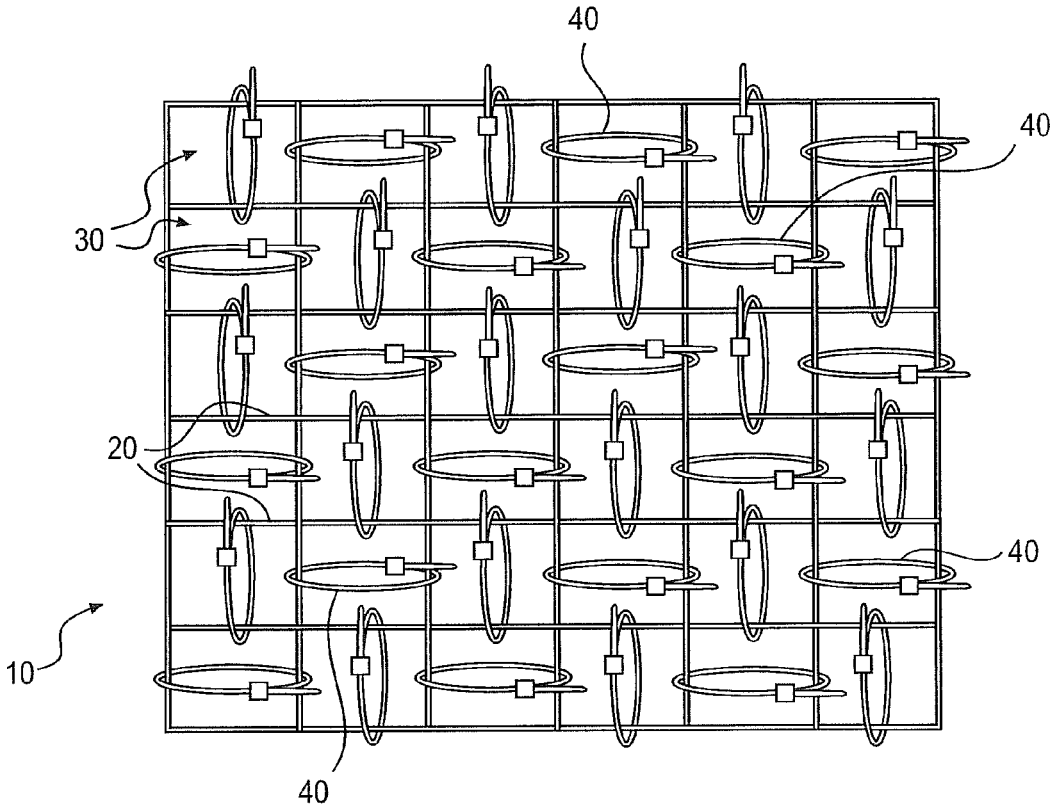
FIG. 3 is a schematic drawing of a flat mesh having a plurality of cross-links interlinking individual strands according to an embodiment.

As shown in FIG. 3, the cross-links 40 may be provided to interlink any two or more strands 30 of the flat mesh 10. By pulling individual pairs of strands 20 closer together, as shown in FIGS. 4-5, the strands of the flat mesh 10 may be rerouted along a less direct path to form a desired curvature/shape, and ultimately a double-curved structure.

Figure 4:
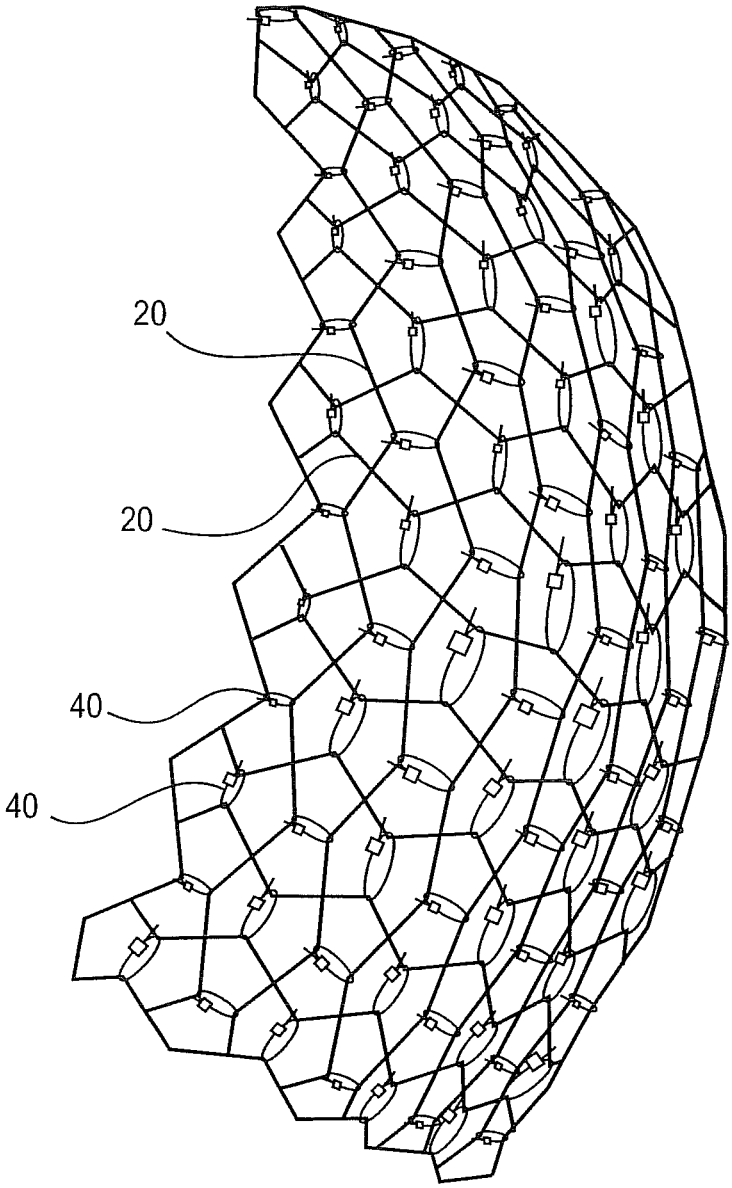
FIG. 4 is a schematic drawing of a double-curved structure according to an embodiment.
Figure 5:
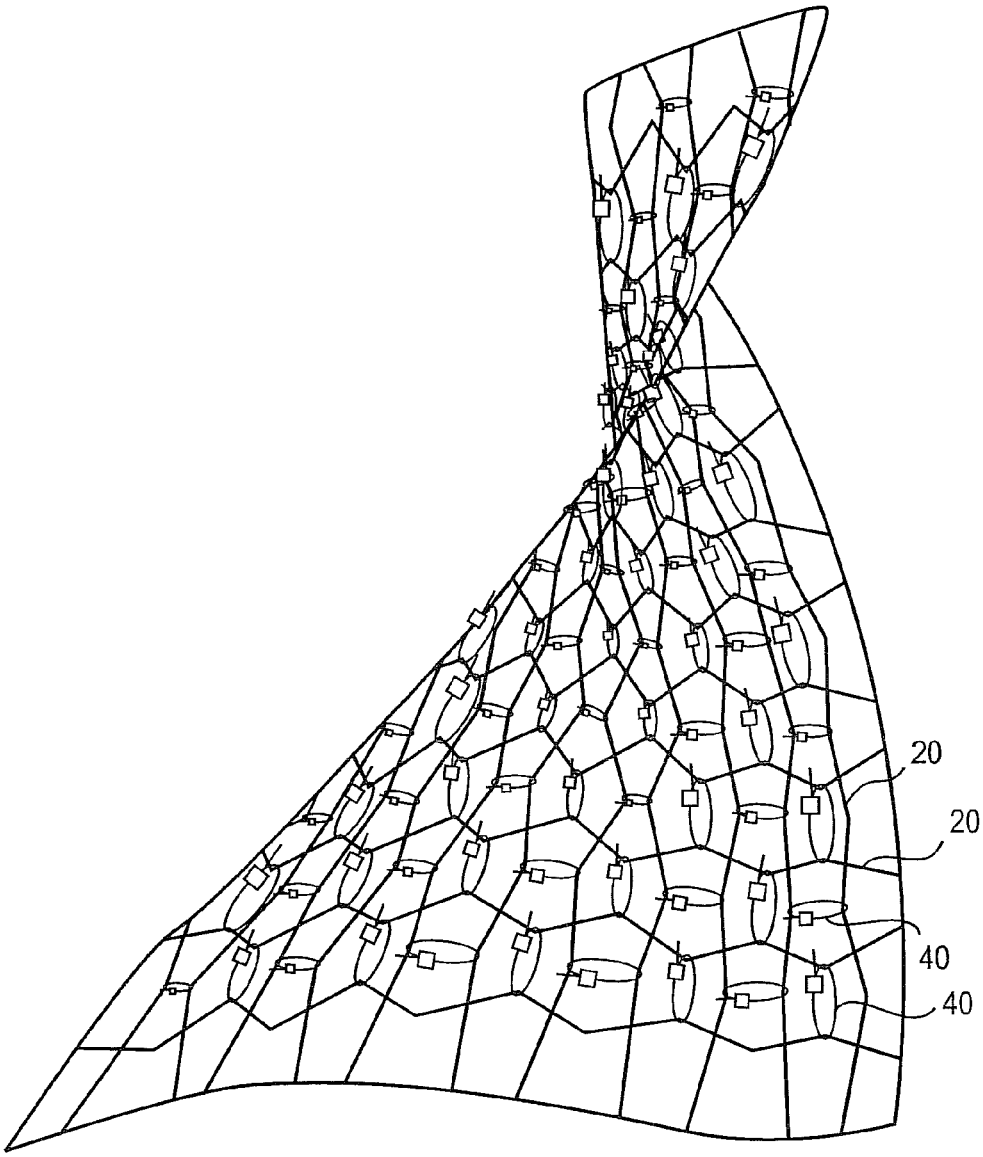
FIG. 5 is a schematic drawing of a double-curved structure according to an embodiment.

FIGS. 4 and 5 are double-curved structures formed using the method according to embodiments. With these examples, a 24" by 24" section of 2" by 2" welded 16 gauge wire mesh was utilized as the flat mesh. Cross-links, in the form of zip-style cable ties, were added, distorting the flat mesh into the observed multi-curved shapes. These exemplary double-curved structures demonstrate that both saddle-shaped and dome/dish-shaped, multi-curved surfaces may be generated by selective introduction of cross-links into a flat mesh or net.

Figure 6:
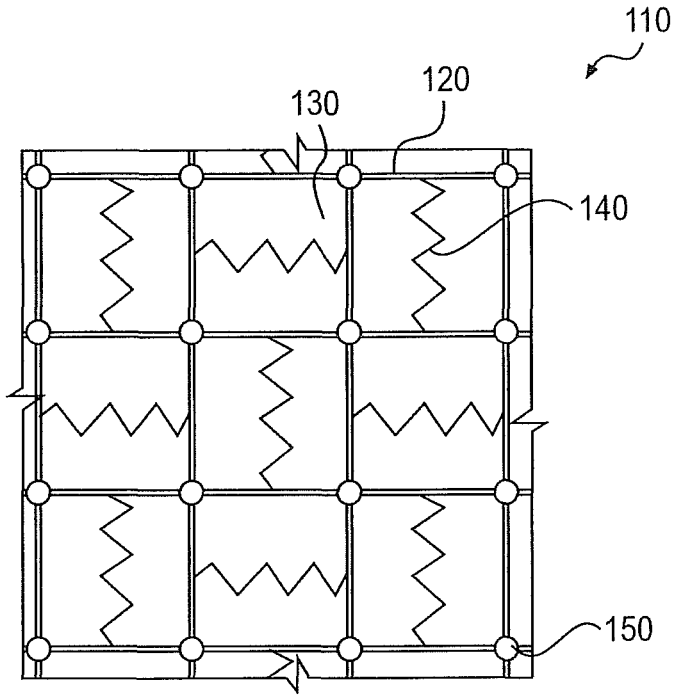
FIG. 6 is a schematic drawing of a portion of a flat mesh having a plurality of cross-links interlinking individual strands according to another embodiment.
Figure 7:
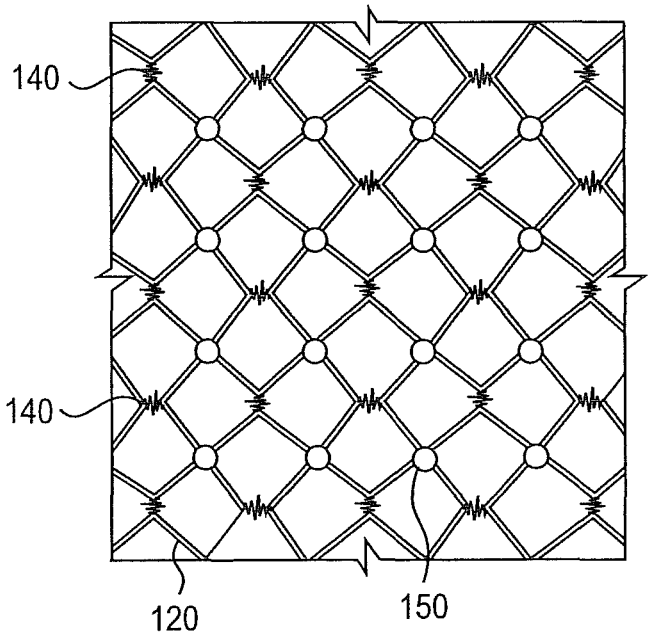
FIG. 7 is a schematic drawing of a portion of the mesh of FIG. 6, shown with cross-links "tightened"
Figure 8:
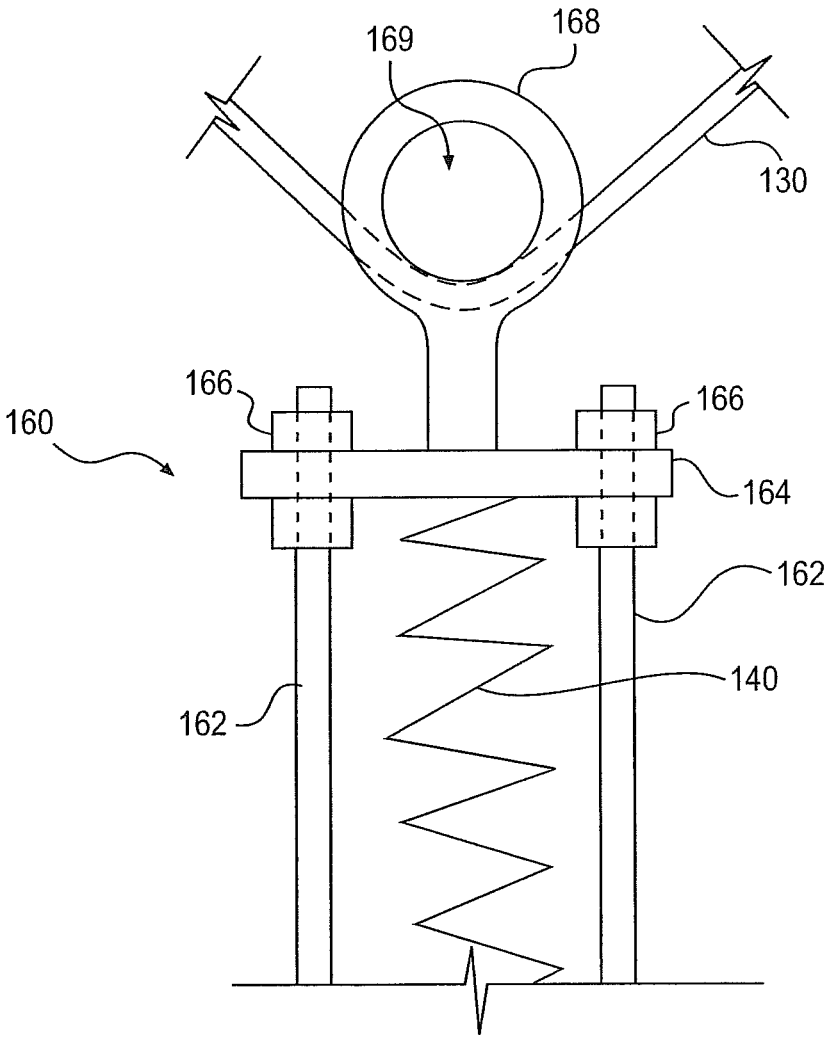
FIG. 8 is a schematic drawing of one end of a locking mechanism that locks a position of an individual tightened cross-link.

FIG. 6 is a schematic drawing of a portion of a flat mesh having a plurality of cross-links interlinking individual strands according to another embodiment. FIG. 7 is a schematic drawing of a portion of the mesh of FIG. 6, shown with cross-links "tightened". FIG. 8 is a schematic drawing of one end of a locking mechanism that locks a position of an individual tightened cross-link.

The flat mesh 110 of FIG. 6 may include a plurality of individual strands 120 arranged, interlaced, or attached to form a plurality of open spaces 130 between the individual strands 120, to thereby form the flat mesh 110. Nodes or knots 150 may be provided where the individual strands 120 intersect, to add stability. The plurality of individual strands 120 may be interlinked by a plurality of cross-links 140.

The plurality of cross-links 140 each may be "pre-programmed" to expand or compress to a predetermined degree. That is, the plurality of cross-links 140 each may be formed of an elastic material configured to expand or compress to a predetermined degree. Once the plurality of cross-links 140 are attached to the strands 120 of the flat mesh 110 and the flat mesh 110 is released or supported, the plurality of cross-links may each automatically expand or compress, respectively, to reroute the individual strands of the flat mesh or net to obtain a desired double-curved structure.

A locking mechanism 160 may be provided to maintain each of the plurality of cross-links 140 in the expanded or compressed configuration. The locking mechanism 160 may include a pair of threaded rods 162 each configured to mate at both ends with a pair of plates 164. A fixing member 166 may be provided to secure the engagement of the rod 162 with the plate 164. The locking mechanism 160 may further include a pair of clevis 168 and pins 169 that secure the locking mechanism 160 to the strands 120.

Figure 9:
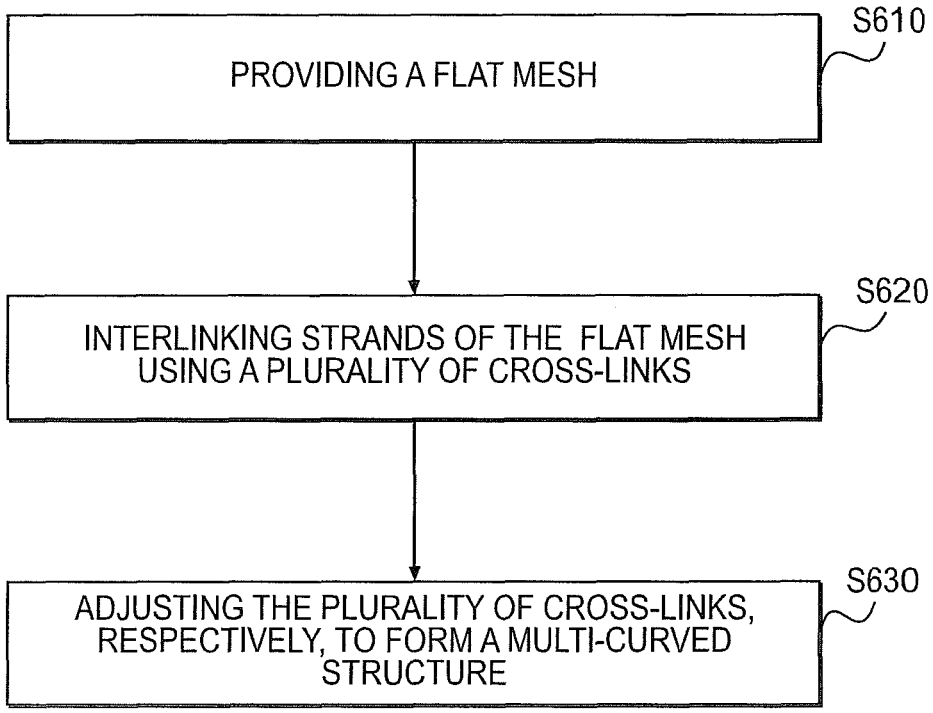
FIG. 9 is a flow chart of a method for forming a double-curved structure according to an embodiment.

FIG. 9 is a flow chart of a method of forming a double-curved structure according to an embodiment. Referring to FIG. 9, the method may include providing a flat mesh, such as flat mesh 10 of FIG. 1, in step S601. The flat mesh may be, for example, formed of any material capable of supporting the loads. For a tensile structure, rope made of metal wire, synthetic polymer, natural fibers, or other materials may be used. Appropriate metals may include steel (including carbon, galvanized, and stainless), aluminum, titanium, and alloys. Metal chain may also be substituted for metal wire rope. Appropriate synthetic polymers may include nylon, polyethylene, polyester, PTFE, and ETFE. Appropriate natural fibers may include cotton, coir, sisal, hemp, bamboo, and jute. Appropriate other materials may include fiberglass, carbon fiber, and carbon nanotubes. For a grid shell, structural members that are capable of resisting compression and bending are necessary. Appropriate materials may include steel, wood, and reinforced concrete. The desired or necessary flexibility and/or strength for the particular application may influence the material selected. However, embodiments are not so limited, and other materials may be appropriate. The flat mesh may include a desired number of strands with open spaces formed therebetween.

Next, the method may include interlinking the strands, such as strands 20 of the flat mesh 10 of FIG. 1, of the flat mesh using a plurality of cross-links, such as the plurality of cross-links 40 of FIGS. 2-3, in step S620. Any two or more strands may be interlinked. For example, as shown in FIG. 3, two adjacent strands may be interlinked for each open spaces of the wire mesh. For example, horizontally extending strands and vertically extending strands may be alternately interlinked so that two strands of each open space are linked. Other interlinking arrangements may also be appropriate based on the desired double-curved structure. Next, in step S630, the plurality of cross-links may be adjusted, respectively, to form a desired multi-curved structure.

Greater access to double-curved surfaces is desirable for both aesthetic and structural reasons. Double-curved surfaces make up the majority of all possible surfaces; flat and single-curved surfaces are only special cases. Giving designers freer rein to utilize these shapes may allow for aesthetically interesting architectural developments. Double-curved surfaces may also be structurally powerful. The most efficient structural forms, that is, domes, dishes, and saddle shapes, are double-curved. Double curvature thus allows for more efficient use of materials, which may be both environmentally and economically beneficial.

The method according to embodiments provides flexibility. The method according to embodiments may be applicable to any scale and any materials. Since many different shapes may be created from the same starting net/mesh, the method according to embodiments allows for economies of scale of mass production, while still allowing architects to have flexibility with their designs. Manufacturers may produce many copies of the same starting mesh/net and cross-link assemblages, while designers may use that standard starting form to generate an infinite variety of desired forms. In addition, the general utility of the method according to embodiments may be further enhanced by the fact that the materials used may be traditional ones, such as steel wire cables, which structural engineers are comfortable analyzing and contractors are comfortable handling.

A double-curved structure formed by the method according to embodiments may be used for all of the usual applications of a traditionally formed double-curved structure. For example, a saddle-shaped structure created using the method according to embodiments may support a membrane for a tent-like fabric structure. Likewise a dome-shaped structure may be a part of a structural system for an air-supported membrane, like ones used to cover tennis courts and some stadiums. If the mesh/net and the cross-links are all capable of resisting compression and other necessary forces, the method according to embodiments may be used to create a double-curved grid shell.

Less traditionally, the method according to embodiments may drive down the costs of forming a double-curved structure, opening up many new applications. Many more will emerge, but for now, two exemplary applications are discussed herein below.

One such application is to use a double-curved structure formed using the method according to embodiments as a pergola. Encouraging plants to grow where their shade falls strategically may reduce urban heat island effect and may earn LEED points. A double-curved structure may easily span across necessary distances and provide structural support to grow plants to provide shade for a roof or a parking lot. Double-curved structures built by traditional methods have always been too expensive for this application, but the method according to embodiments may make this application economically accessible.

Figure 10:
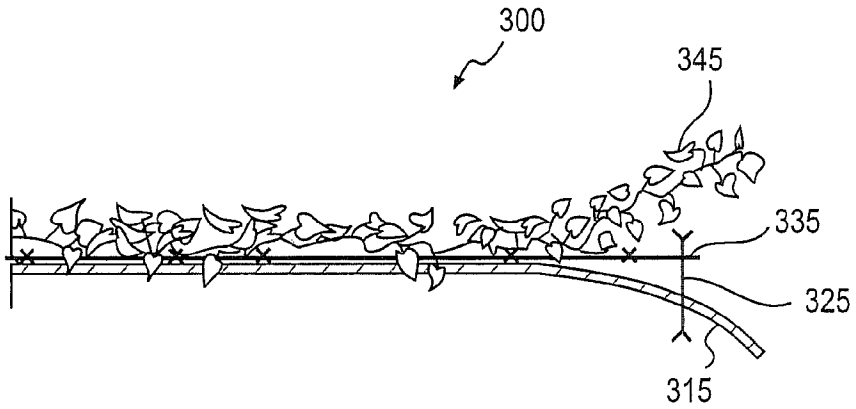
FIG. 10 is a schematic cross-section of a portion of a pergola formed using a method for forming a double-curved structure according to an embodiment.

FIG. 10 is a schematic cross-section of a portion of a pergola formed using a method for forming a double-curved structure according to an embodiment. In FIG. 10, portions of the various layers are shown peeled away for ease of explanation.

To create a pergola 300, a wire or cable rope net may be used as the flat mesh. For example, a wire rope or cable net with openings approximately 8' by 8' may be utilized. The wire rope or cable net may be raised into position on supports (not shown). Supports may be, for example, posts or columns, walls, frames, trussed towers, buildings, or any other type of structure capable of resisting the loads imposed by the net structure. Supports may be made of steel, aluminum, concrete, or any other material capable of resisting the loads. Guy wires or ropes may be used to reduce the induced bending moments in the supports. Appropriate materials for guy wires/ropes are the same as might be used for a tensile net, as discussed above. A plurality of cross-links, either mechanically adjustable by a user or automatically adjustable, may function to reroute the individual strands of the flat mesh or net to perform form-finding to obtain a desired double curved structure, such that the openings are reduced to between 4'×4' and 4'×8'.

The thus formed double-curved structure 315 may then serve as a framework to support, for example, wire fencing 335, such as hexagonal wire fencing or chicken wire, which may be easily stretched onto the double-curved shape. A plurality of attachment members 325, such as ties, may be used to attach the wire-fencing to the double-curved structure. Climbing vines 345 may then be trained to climb the completed pergola structure.

Another application may use a double-curved structure made using the method according to embodiments as a structural basis for forming a double-curved concrete shell. Concrete may easily take any form, and double-curved shells are extremely efficient structurally. The only reason that many concrete shells are not built is because it has been too difficult/expensive to build a double-curved framework on which to pour the wet concrete. The method according to embodiments may change that cost/benefit ratio. For example, a membrane may be positioned on top of wire fencing which in turn is supported by a double-curved structure made using the method according to embodiments. Rebar and concrete may be placed on top, and the concrete allowed to cure. Once the concrete has attained sufficient strength, the membrane, wire fencing, and mesh/net framework may be removed and possibly reused. Alternatively, the membrane may be suspended just below the double-curved net and wire fencing combination, then the concrete poured. The double-curved net and wire fencing combination may then become part of permanent reinforcing within the concrete. This may save time, expense, and waste associated with stripping concrete forms.

Figure 11:
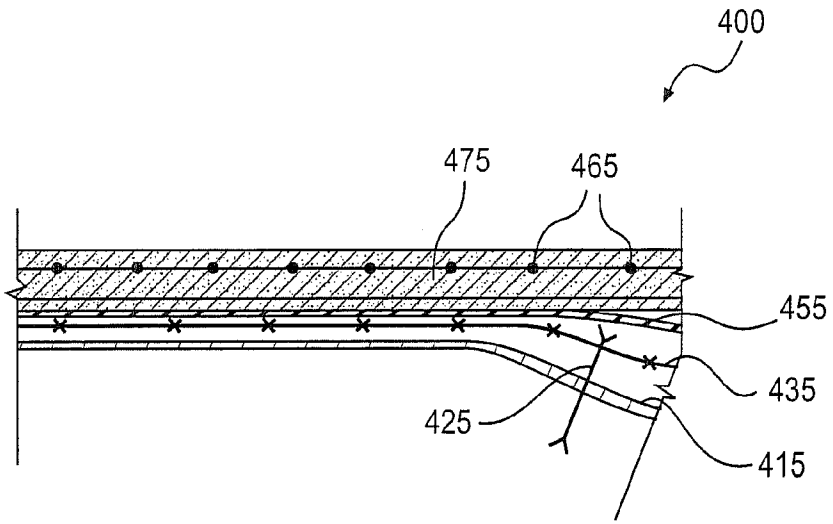
FIG. 11 is a schematic cross-section of a portion of a double-curved concrete shell formed using a method for forming a double-curved structure according to an embodiment.

FIG. 11 is a schematic cross-section of a portion of a double-curved concrete shell formed using a method for forming a double-curved structure according to an embodiment. In FIG. 11, portions of the various layers are shown peeled away for ease of explanation.

To create a concrete shell 400 according to this embodiment, for use as a roof or wall, for example, a wire or cable rope net may be used as the flat mesh. For example, a wire rope or cable net with openings approximately 8' by 8' may be utilized. The wire rope or cable net may be raised into position on supports (not shown). Supports may be, for example, posts or columns, walls, frames, trussed towers, buildings, or any other type of structure capable of resisting the loads imposed by the net structure. Supports may be made of steel, aluminum, concrete, or any other material capable of resisting the loads. Guy wires or ropes may be used to reduce the induced bending moments in the supports. Appropriate materials for guy wires/ropes are the same as might be used for a tensile net, as discussed above. A plurality of cross-links, either mechanically adjustable by a user or automatically adjustable, may function to reroute the individual strands of the flat mesh or net to perform form-finding to obtain a desired double-curved structure, such that the openings are reduced to between 4'×4' and 4'×8'.

The thus formed double-curved structure 415 may then serve as a framework to support, for example, wire fencing 435, such as hexagonal wire fencing or chicken wire, which may be easily stretched into the double-curved shape. A plurality of attachment members 425, such as ties, may be used to attach the wire-fencing to the double-curved structure.

Next, a stretchy membrane 455, such as a sheet of rubber, neoprene, or spandex, may be layered onto the double-curved structure 415-wire fencing 435 combination. Rebar 465 may be put in place, before pouring concrete 475 onto the membrane 455. The double-curved structure 415 may support the wire fencing 435, which may support the membrane 455, which may support the wet cement.

A heat shrink film may be used as an alternative to the stretchy membrane. Further, thatching or shingles, paper mache, fiberglass, stucco, plaster, spray applied expanding foam, or biorock could replace the concrete. These alternative materials may make the stretchy membrane and heat shrink film unnecessary as well.

In the case of concrete, when the concrete dries, the double-curved structure 415, the wire fencing 435, and the membrane 455 may be removed for reuse.

Figure 12:
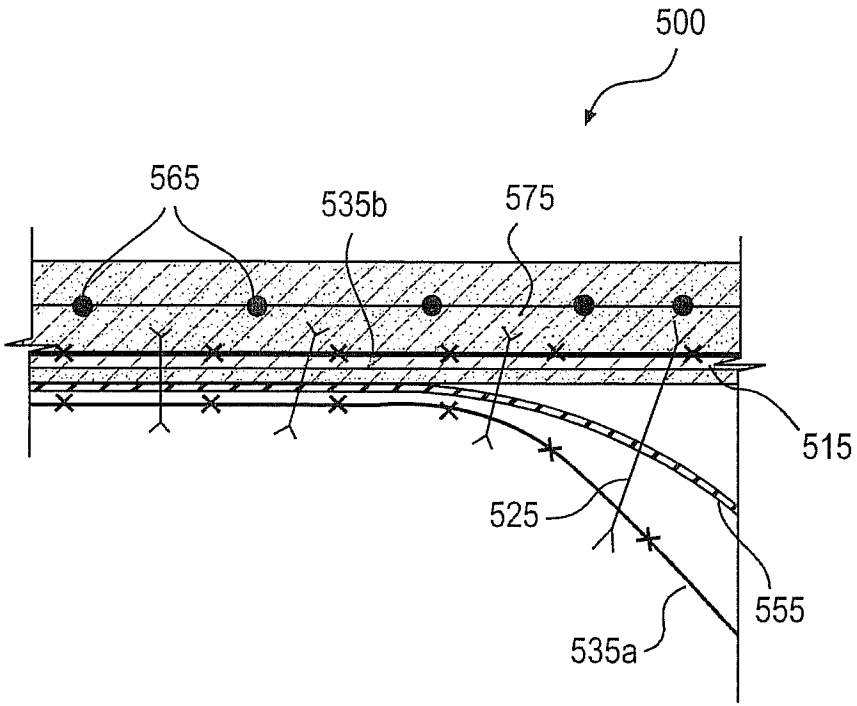
FIG. 12 is a schematic cross-section of a portion of another double-curved concrete shell formed using a method for forming a double-curved structure according to an embodiment.

FIG. 12 is a schematic cross-section of a portion of another double-curved concrete shell formed using a method for forming a double-curved structure according to an embodiment. In FIG. 12, portions of the various layers are shown peeled away for ease of explanation.

To create a concrete shell 500 according to this embodiment, for use as a roof or wall, for example, a wire or cable rope net may be used as the flat mesh. The wire rope or cable net may be raised into position on supports (not shown). Supports may be, for example, posts or columns, walls, frames, trussed towers, buildings, or any other type of structure capable of resisting the loads imposed by the net structure. Supports may be made of steel, aluminum, concrete, or any other material capable of resisting the loads. Guy wires or ropes may be used to reduce the induced bending moments in the supports. Appropriate materials for guy wires/ropes are the same as might be used for a tensile net, as discussed above. A plurality of cross-links, either mechanically adjustable by a user or automatically adjustable, may function to reroute the individual strands of the flat mesh or net to perform form-finding to obtain a desired double-curved structure.

A first layer of wire fencing **535*b*, such as hexagonal wire fencing or chicken wire, which may be easily stretched into a double-curved shape, may be supported off of the double-curved structure 515. A second layer of wire fencing 535*a* may then be suspended from the first layer of wire fencing 535*b*. A stretchy membrane 555, such as a sheet of rubber, neoprene, or spandex, may be supported on this second layer of wire fencing 535*a*. A plurality of attachment members 525, such as ties, may be used to suspend the second layer of wire fencing 535*a* from the first layer 535*b*. Short ties (not shown) may also be used to connect the upper layer of wire fencing 535*b*** directly to the double-curved structure.

Rebar 565 may be put in place, before pouring the concrete 575. The double-curved structure 515 may support the wire fencing **535*a* and 535*b*, which may support the membrane 555**, which may support the wet cement.

A heat shrink film may be used as an alternative to the stretchy membrane.

Further, thatching or shingles, paper mache, fiberglass, stucco, plaster, spray applied expanding foam, or biorock could replace the concrete. These alternative materials may make the stretchy membrane and heat shrink film unnecessary as well.

In the case of concrete, when the concrete dries, the wire fencing 535*a* and the membrane 555 may be removed for reuse; however, the double-curved structure 515 may remain embedded in the concrete 575.

Different starting mesh/net layouts may allow access to different double-curved shapes. Rectangular meshes/nets may provide subtly different opportunities than square. Radial nets may provide very different opportunities.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method for forming a double-curved structure, the method comprising:

providing a substantially flat mesh formed of a plurality of strands, each of the plurality of strands having a first end and a second end, wherein the first end is not connected to the second end and wherein a node or knot is provided where each of the plurality of strands intersects another of the plurality of strands securing the strands to one another at each node or knot;

interlinking the plurality of strands of the flat mesh using a plurality of cross-links; and adjusting the plurality of cross-links to widen or narrow open spaces between the plurality of strands, thereby forming the double-curved structure.

2. The method of claim 1, wherein the plurality of strands of the flat mesh are not formed of individual rings.

3. The method according to claim 1, wherein the flat mesh is square, rectangular, or radial.

4. The method according to claim 1, wherein interlinking the plurality of strands of the flat mesh comprises providing one of the plurality of cross-links linking two adjacent strands of the flat mesh formed by the plurality of strands of the flat mesh.

5. The method according to claim 1, wherein interlinking the plurality of strands of the flat mesh comprises providing a cross link linking two adjacent strands of the flat mesh within each open space of the flat mesh.

6. The method according to claim 1, wherein interlinking the plurality of strands of the flat mesh comprises providing a cross link for each open space of the flat wire mesh.

7. The method of claim 1, wherein adjusting the plurality of cross-links to form the double-curved structure comprises at least one of individually tightening or loosening certain ones of the plurality of cross-links to form the double-curved structure.

8. The method of claim 1, wherein the plurality of cross-links are each formed of an elastic material attached to two strands of the flat mesh.

9. The method of claim 8, wherein adjusting the plurality of cross-links to form the double-curved structure comprises releasing or supporting the flat mesh, such that the plurality of cross-links each either compresses or expands to form the double-curved structure.

10. The method of claim 9, further comprising:

providing a plurality of locking mechanisms to lock a portion of the plurality of cross-links.

11. The method of claim 1, wherein the plurality of strands of the flat mesh comprises at least one first strand that extends in a first direction along a first length thereof and at least one second strand that extends in a second direction along a second length thereof, the second direction being different than the first direction.

12. The method of claim 11, wherein the second direction is substantially perpendicular to the first direction.

13. The method of claim 11, wherein the first direction is at a predetermined angle to the second direction.

14. The method of claim 13, wherein the predetermined angle is approximately 90 degrees.

15. The method of claim 11, wherein the first direction is a substantially horizontal direction and the second direction is a substantially vertical direction.

16. The method according to claim 15, wherein interlinking the plurality of strands of the flat mesh comprises providing cross-links alternately extending between adjacent horizontally extending strands and adjacent vertically extending strands for each open space of the open spaces between the plurality of stands.

providing a plurality of locking mechanisms to lock a portion of the plurality of cross-links.

17. A method for forming a double-curved structure, the method comprising:

providing a substantially flat mesh formed of a plurality of strands, each of the plurality of strands having a first end and a second end, wherein the first end is not connected to the second end, and wherein a node or knot is provided where each of the plurality of strands intersects another of the plurality of strands securing the strands to one another at each node or knot;

interlinking the plurality of strands of the flat mesh using a plurality of cross-links that extend between the individual strands; and releasing or supporting the flat mesh so that the plurality of cross-links automatically expand or compress to widen or narrow open spaces between the plurality of strands, thereby forming the double-curved structure.

18. The method of claim 17, further comprising:

providing a plurality of locking mechanisms to lock a portion of the plurality of cross-links.

19. A method for forming a double-curved structure, the method comprising:

providing a substantially flat mesh formed of a plurality of strands, wherein a node or knot is provided where each of the plurality of strands intersects another of the plurality of strands securing the strands to one another at each node or knot for stability and the strands are not formed of individual rings;

interlinking the plurality of strands of the flat mesh using a plurality of cross-links; and adjusting the plurality of cross links to widen or narrow open spaces between the plurality of strands, thereby forming the double-curved structure.

20. A double-curved structure created using the method of claim 1.

21. The double-curved structure of claim 20, wherein the double-curved structure is in a saddle shape.

22. The double-curved structure of claim 20, wherein the double-curved structure is in a dome shape.

23. The double-curved structure of claim 20, wherein the double-curved structure is used to form a pergola.

24. The double-curved structure of claim 20, wherein the double-curved structure is used to form a wall.

25. The double-curved structure of claim 24, wherein the wall is formed of one of concrete, thatching or shingles, paper mache, fiberglass, stucco, plaster, spray applied expanding foam, or biorock.

26. The double-curved structure of claim 20, wherein the double-curved structure is used to form a roof.

27. The double-curved structure of claim 26, wherein the roof is formed of one of concrete, thatching or shingles, paper mache, fiberglass, stucco, plaster, spray applied expanding foam, or biorock.

* * * * *